US005893608A

United States Patent [19]

Cravenor

[11] Patent Number: 5,893,608

[45] Date of Patent: Apr. 13, 1999

[54] SUN-TRACKING CHAIR

[76] Inventor: William Cravenor, 13150 Kiowa Rd., Apple Valley, Calif. 92308-6453

[21] Appl. No.: 08/847,784

[22] Filed: Apr. 28, 1997

[51] Int. Cl.[6] ..... A47C 1/00

[52] U.S. Cl. ..... 297/217.3; 297/217.7; 297/344.23; 607/95

[58] Field of Search ..... 297/217.1, 217.3, 297/217.7, 344.21, 344.23, 344.26, 354.13, 354.12, 361.1, 362.11; 607/95

[56] References Cited

U.S. PATENT DOCUMENTS

| | | | |
|---|---|---|---|
| 3,908,666 | 9/1975 | Osborne | 128/372 |
| 4,379,588 | 4/1983 | Speice | 297/217.7 X |
| 4,612,488 | 9/1986 | Uhlemann et al. | 318/582 |
| 4,915,120 | 4/1990 | Zidkowski | 297/184.17 X |
| 4,933,618 | 6/1990 | Ortlieb | 297/217.3 X |
| 4,989,600 | 2/1991 | Collier | 128/372 |
| 5,211,172 | 5/1993 | McGuane et al. | 297/217.7 X |
| 5,489,142 | 2/1996 | Mathieu | 297/217.7 X |
| 5,564,784 | 10/1996 | Felling | 297/344.23 |

*Primary Examiner*—Peter R. Brown
*Attorney, Agent, or Firm*—Steins & Associates

[57] ABSTRACT

A Sun-tracking Chair is disclosed. The disclosed chair comprises inclinable back and and leg rests. Further disclosed is a sun-tracking means for tracking the sun's position with relation to said chair. Still further disclosed are a back rest and leg rest that automatically incline responsive to the sun's azimuth, as detected by said sun-tracking means. The disclosed chair further comprises rotating means for rotating said chair, and in particular, said chair is automatically rotatable responsive to the angle of the sun in a horizontal plane with relation to said chair, as detected by said sun-tracking means. Said disclosed chair further comprises control means for controlling the functions of said chair, including incline and rotation angle. The disclosed chair further comprises a canopy, said canopy configured to cooperate with said back and leg rests and the rotation of said chair. Also disclosed is a system to position adjacent chairs in close proximity to one another simultaneously and synchronously to avoid their coming into contact with each other.

17 Claims, 6 Drawing Sheets

SUN-TRACKING CHAIR

BACKGROUND OF THE INVENTION

1. Field of the Invention

This invention relates generally to seating apparatus and, more specifically, to a Sun-tracking Chair.

2. Description of Related Art

There are many shapes, sizes and configurations of outdoor lounge chairs. The typical prior outdoor lounge chair comprises a leg rest, a center section and a back rest. Generally, the leg rest and back rest can be angularly adjusted to provide the maximum comfort to the user in a variety of situations. In particular, where the user desires to sunbathe on the prior chair, he or she will set the incline of the backrest such that when lying on the chair, his or her torso is perpendicular to the azimuth of the sun. It is in such a configuration that the user will receive the maximum incident sun rays and, therefore the best tanning potential.

The problem with these prior chairs is that the sun's azimuth is constantly changing during the day. Since the typical backrest on the prior chairs is only adjustable manually, the user typically adjusts the incline of the backrest to match the sun's azimuth at that particular point in time. He or she then sunbathes until the azimuth has changed a substantial amount at which time, the user manually readjusts the backrest incline to match the sun's azimuth once again. As can be seen, the user's torso is only in the optimum sunbathing position for a short time after each incline adjustment. If better precision is desired, the user must manually readjust the incline more frequently—this can rapidly become a nuisance to the user. What is needed is a system that automatically adjusts the incline of the backrest of outdoor lounge chairs to track the azimuth of the sun.

Many times sunbather must make more adjustment to the chair than simply the backrest incline. If the sun is particularly low in the sky, the horizontal angle to the sun changes during the day, in addition to the azimuth changing. In order for the user to maintain perpendicularity with the sun rays in such cases, he or she must actually turn the chair to face the sun. Again, it becomes a nuisance "chasing" the sun across the sky. It would be very beneficial if the outdoor lounge chair would automatically rotate to track the sun's changes in horizontal angle.

The chair rotation problem becomes particularly troublesome where there is a dense concentration of chairs, such as around a swimming pool, where one chair cannot be easily rotated without disturbing the adjacent chairs. This phenomena is particularly bothersome on cruise ships, where many chairs are set close together and defined walkways must be left open for safety egress, the rotation space for chairs is thus severely limited. This situation is further exacerbated when the ship makes a turn, and the sun's angle is radically changed very quickly. It becomes a mass scramble for the sunbathers to jump up and readjust the configuration of their chairs, typically bumping into each other and generally causing significant frustration. It Would be very helpful if a row of chairs would automatically rotate in a synchronized fashion, so that they can be placed in close proximity to each other, yet afford the sunbather with consistent, optimum exposure to the sun without the need for any action on their part.

It would be further beneficial if the sun-tracking chair included a canopy thereover that cooperated with the chair backrest incline and rotation adjustments. In such a manner, users that don't desire sun, but simply want to lay outside along with their sunbathing friends will be protected by the sun, but will not interfere with the movements of the sunbathers.

SUMMARY OF THE INVENTION

In light of the aforementioned problems associated with the prior devices, it is an object of the present invention to provide a Sun-tracking Chair. It is another object that the chair include a base and inclinable back and leg rests. It is a further object that the chair include a sun-tracking means for tracking the sun's position with relation to the chair. It is a still further object that the back rest and leg rest automatically incline responsive to the sun's azimuth, as detected by the sun-tracking means. It is a further object that the chair be rotatable, and in particular, automatically rotatable responsive to the angle of the sun in a horizontal plane with relation to the chair, as detected by the sun-tracking means. It is a further object that the chair have control means for controlling the chair functions, including incline and rotation angle. It is a still further object that the chair include a canopy that cooperates with the back and legs rests and chair rotation. It is a final object that adjacent chairs in close proximity to one another operate simultaneously and synchronously with each other to avoid coming into contact with each other.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Sun-tracking Chair.

Figure 1:
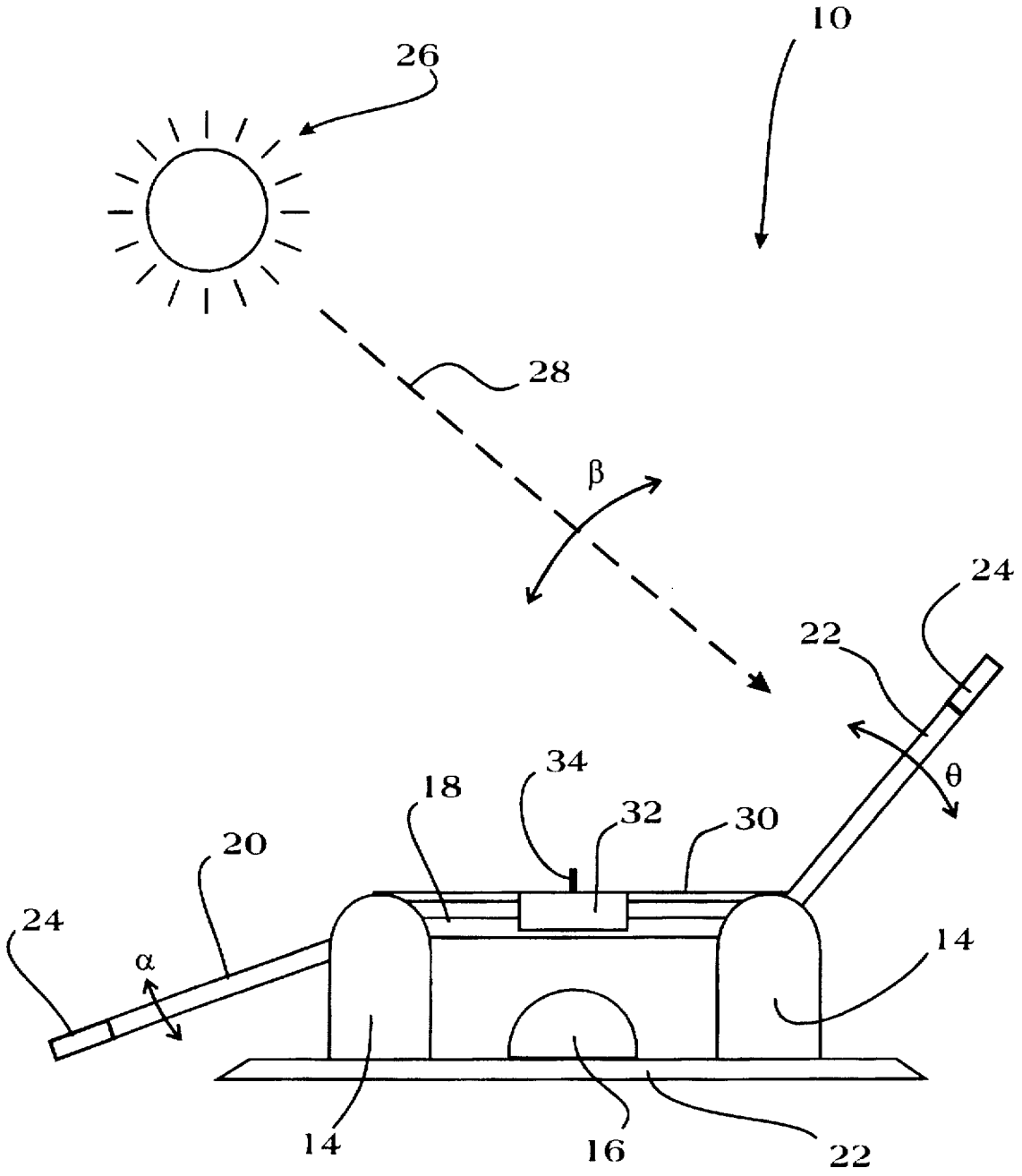
FIG. 1 is a side view of a preferred embodiment of the present invention.

The present invention can best be understood by initial consideration of FIG. 1. FIG. 1 is a side view of a preferred embodiment of the sun-tracking chair 10 of the present invention. The preferred chair 10 comprises a base 12 from which extend a plurality of support members 14. In the present embodiment, there are four support members 14 (only two are displayed), however the reader should appreciate that many different configurations are possible, such as a single large support member 14, as well as different shapes and sizes of support members 14. Also located on the base 10 may be rotating means 16 for causing the base 10 to rotate. Further detail in regards to the rotating means 16 will be discussed below.

Extending between and supported by the support members 14 is a center section 18 which forms one portion of the seating surface of the chair 10. The center section 18 may be constructed in a variety of ways in order to provide the maximum comfort and durability, including rubber straps, cushions or other well-known configurations. Extending from one end of the center section 10 is a leg rest 20 that may be at an incline angle $\alpha$ from horizontal. The preferred leg rest 20 is hinged to the center section 18 and/or the support members 14 so that the incline angle $\alpha$ can be adjusted for maximum comfort.

Extending from the opposing end of the center section 18 is a back rest 22, that is also preferably hinged to the center section 18 and/or the support members 14, such that it's incline angle $\theta$ is adjustable for maximum comfort.

In operation, the incline angle $\theta$ of the back rest 22 (and the incline angle $\alpha$ of the leg rest 20, if desired), can be adjusted. In particular, the sunbather generally desires the back rest 22 to be perpendicular to the sun's azimuth 28 to provide maximum sun exposure.

A critical aspect of the present invention is the sun-tracking means 24, and its interaction with the incline angles $\alpha$ and $\theta$. In its preferred form, the back rest 22 and leg rest 20 are equipped with the necessary apparatus to be automatically adjusted by internal mechanisms and/or systems (i.e. internal to the chair 10) in response to signals from the sun-tracking means 24. As the sun 26 crosses the sky, the sun-tracking means 24 will detect its location and direct the chair 10 to adjust the back rest 22 and/or leg rest 20 to maintain the user's desired incline angles $\theta$ and $\alpha$ automatically.

As shown in FIG. 1, there are a pair of sun-tracking means 24; one extending from the end of the backrest 22, and one extending from the end of the leg rest 20. The location of the sun-tracking means 24 is not critical with respect to the overall construction of the chair 10, as long as each has a clear line to the sun 26. In this particular embodiment, the locations were chosen to provide maximum utility. The chair 10, as shown, is essentially double-ended. Should the sun 26 be over the leg rest 20 (as depicted here), the sunbather would lay with his or her torso resting on the back rest 22. If, however, the sun is over the back rest 22, a sunbather would be able to switch ends, and lay with his or her torso on the leg rest 20; the incline angle $\alpha$ could then be increased above horizontal until the sunbather's torso was perpendicular to the sun's azimuth 28. Likewise, the incline angle $\theta$ of the back rest 22 could be lowered below horizontal to make the user's legs more comfortable. When the sun 26 passes the center of the sky, therefore, the user simply needs to indicate to the chair 10 that he or she desires to switch ends, after which the chair 10 will treat the leg rest 20 as the "back rest" and the back rest 22 as the "leg rest" for purposes of incline angle adjustment.

Also depicted in FIG. 1 is one of a pair of arm rests 30 for the users arm. There are well-known designs for arm rests 30, that may include drink holders or other configurations to provide maximum utility to the user. In the present depiction, one (or both) arm rests 30 may include a control means 32 for controlling the functioning of the chair 10. The control means 32 may include a variety of devices, including a joystick 34 such as for manual control of the positioning of the chair; other types of devices that may be included are discussed below in connection with other Figures.

Figure 2:
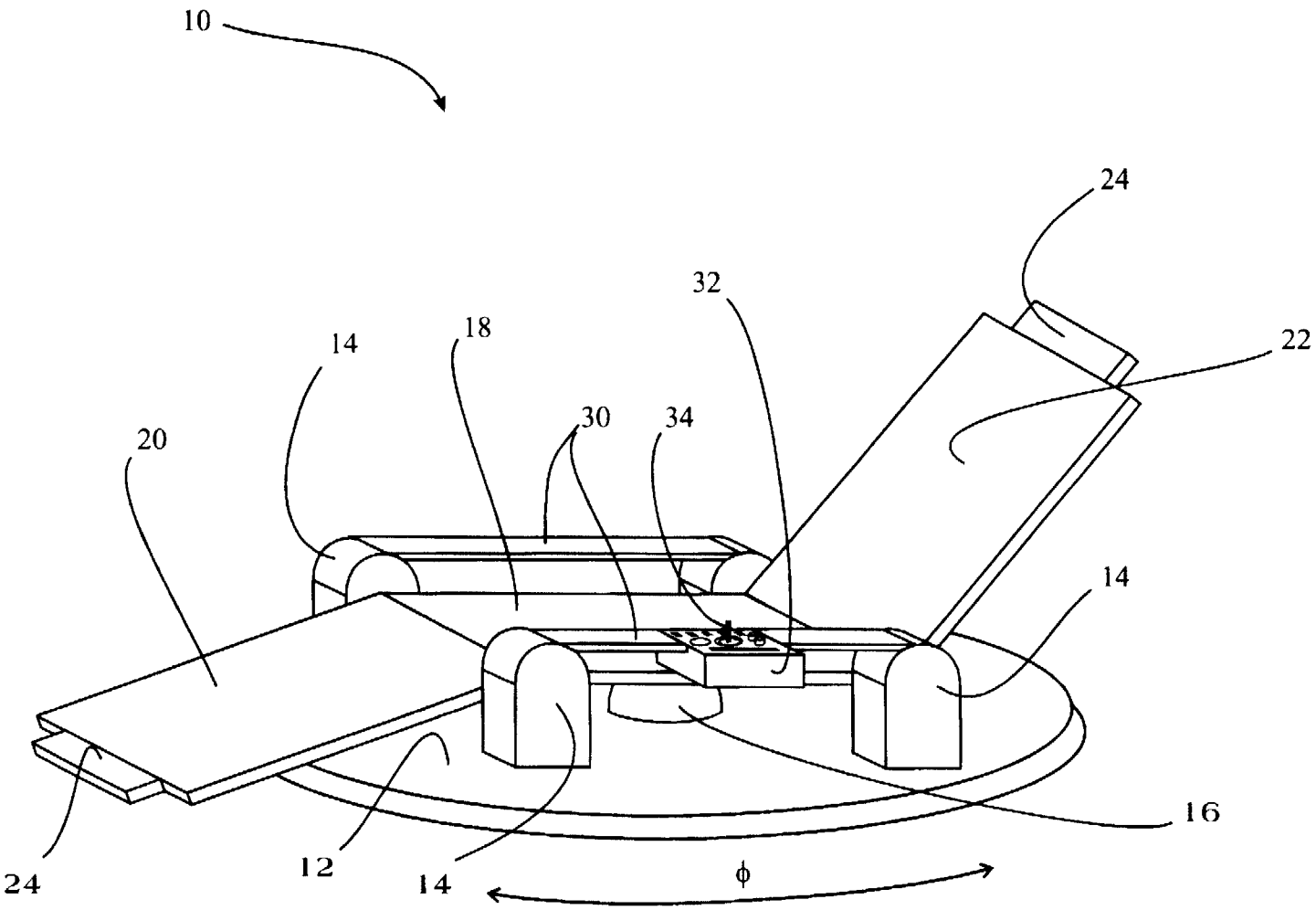
FIG. 2 is perspective view of the preferred embodiment of FIG. 1.

Now turning to FIG. 2, one might appreciate additional unique aspects and advantages of the present invention. FIG. 2 is perspective view of the preferred sun-tracking chair 10 of FIG. 1. From this view, one can appreciate that the rotating means 16 may be included to drive the base 12 through a rotation angle $\phi$, if desired. The rotating means 16 may be any number of mechanisms and/or systems that can create angular forces and motion, including motors, magnets, gears and hydraulic systems, among others. The rotational movement, like the positioning of the back rest 22 and leg rest 20 can be controlled manually, such as by the joystick 34, or automatically in response to input from the sun-tracking means 24. In other words, if the angle of the sun is changing in a horizontal plane, while potentially also changing in azimuth, the chair 10 can automatically adjust its configuration so that the back rest 22 or leg rest 20 (or both) is perpendicular to the incident sun rays.

Figure 3:
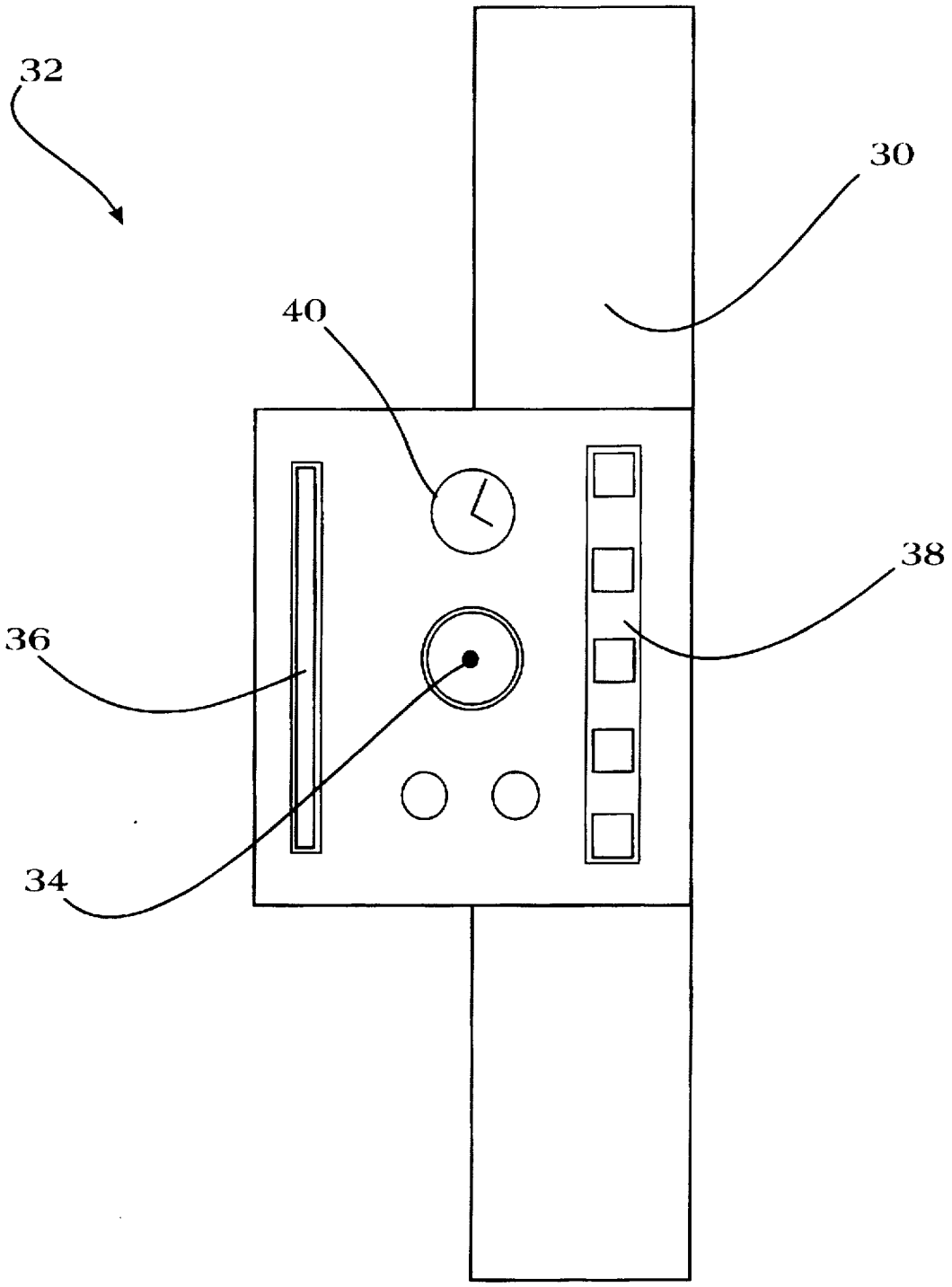
FIG. 3 is a top view of a preferred control means of the present invention.

Now turning to FIG. 3, we may discuss other unique features of the present invention. FIG. 3 is a top view of a preferred control means 32 of the present invention. As can be seen the control means 32 may be a box mounted on one of the arm rests 30. The depicted design is not critical to the invention; any number of configurations, locations and designs of control means 32 is possible, including devices remote from the chair altogether, such as at a central control station or wirelessly in communication with the chair, depending upon the particular application for the chair.

In this embodiment of the control means 32, one can see the joystick 34 for manual positioning of the chair. Also shown is an installed sound system, such as the Compact Disc player 36. The speakers for this system could be hidden within the back rest (see FIGS. 1 and 2), or could be located in a headset worn by the user and plugged into an outlet located on the chair. The control means 32 may also include a series of function buttons 38 to accomplish a variety of functions, such as hailing an attendant, activating an intercom, changing the mode of the chair from manual to automatic and vice-versa, as well as many other possible functions. Further included in the depicted control means 32 might be a timer 40 or clock. A timer 40 may interact with the positioning circuits of the chair so that the positioning of the chair is time-dependent. For example, the user might desire to be lowered into an outstretched position (such as for a comfortable nap) for a period of time, to be followed by an automatic inclination of the back rest (see FIGS. 1 and 2) to optimum sun-tanning angle. As such, the timer 40 could be programmed to direct the control means 32 to adjust the chair in this way automatically. Again, this is simply a single possibility for the functionality of the control means 32; many other capabilities may be included, depending upon the particular location or application for the chair.

Figure 4:
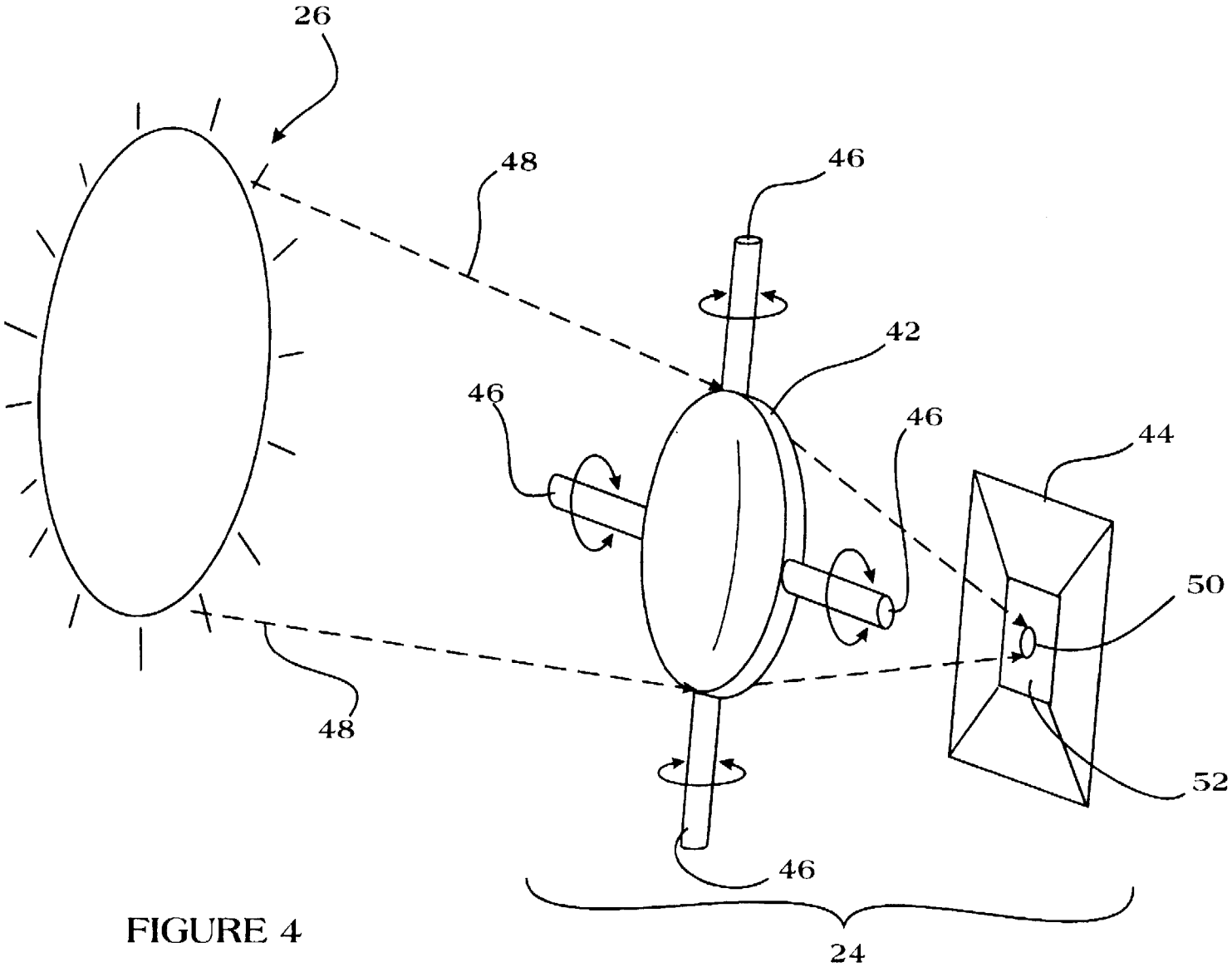
FIG. 4 is a perspective view demonstrating how a preferred sun tracking means might function.

Through consideration of FIG. 4, an understanding of the functioning of the sun-tracking means 24 may be acquired. FIG. 4 is a perspective view demonstrating how a preferred sun-tracking means 24 might function. In essence, the sun-tracking means 24 may comprise a sun-receiving means 42 layered over a sun-detecting means 44. The sun-receiving means 42 is represented here by an optical lens (like the magnifying glass children play with) that is suspended by a plurality of spindles 46. As incident light 48 from the sun passes through the sun-receiving means 42, it is focused to a point where it strikes the sun-detecting means 44. The sun-detecting means 44 may be a variety of known devices that can sense gradients of light and/or heat (a thermometer in its simplest form) and output a signal that can be used to determine where the image 50 is striking its surface. The sun-detecting means 44 could also be of solid-state electronic design. As can be seen, if the image 50 of the focused incident light 48 from the sun is not within the target of the sun-detecting means 44, the appropriate spindle(s) 46 can be rotated by a necessary angle to re-align the sun-receiving means 42 such that the image 50 strikes the target 52.

Translating the sun's movement into chair adjustment is a simple case of directing the chair to adjust in the direction indicated by the direction of annular correction of the spindles 46, until such time as the image 50 is on the target 52 and the spindles 46 have returned to their original angular positions.

If the sun-tracking means 24 is not attached directly to, and in angular communication with the back rest (see FIGS. 1 and 2), but is, for example mounted remote to the chair(s), a different control iteration would be necessary, such as to simply have the chair(s) follow the angular change of the spindles 46 (with some correction multiple, of course).

Figure 6:
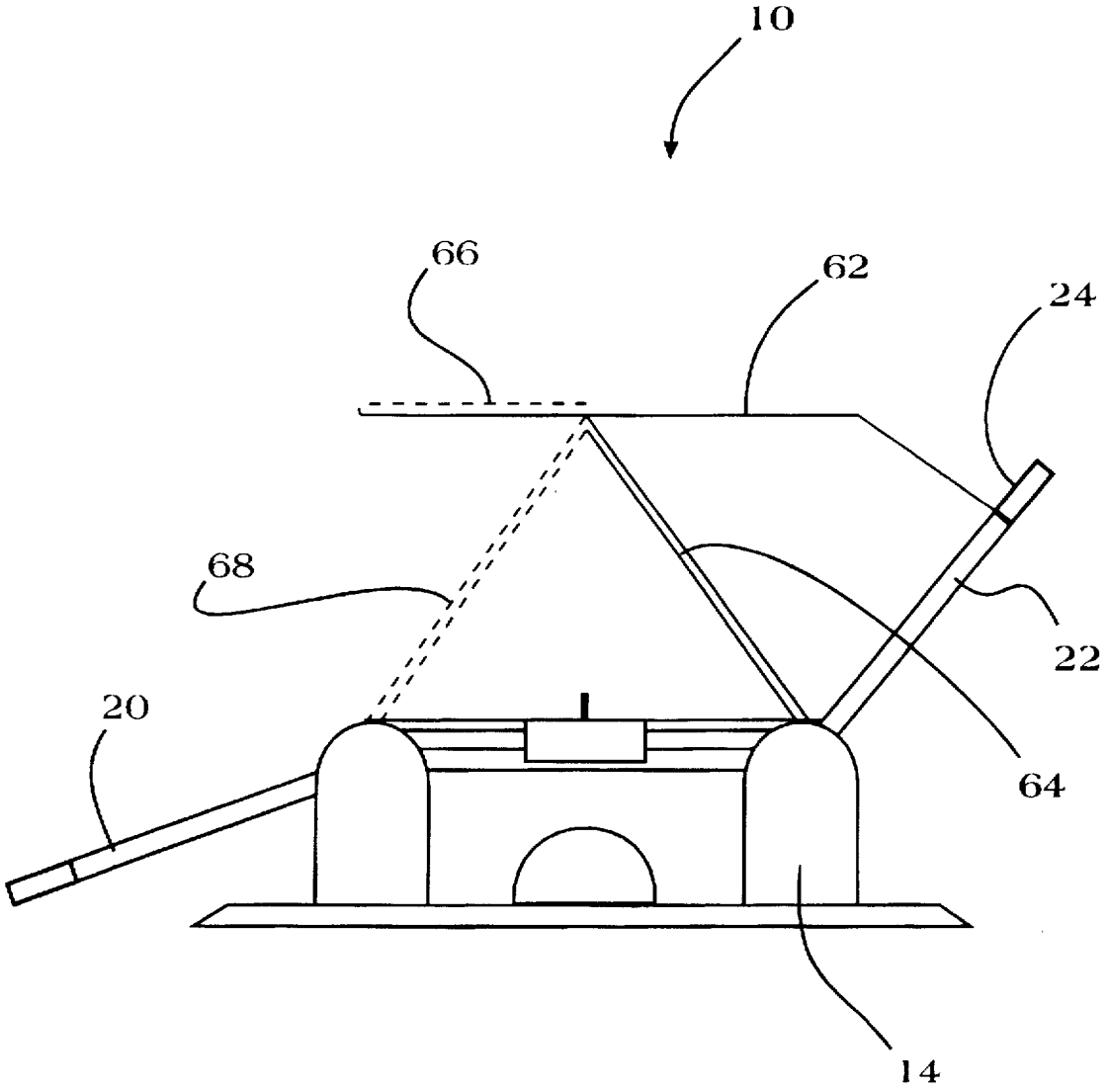
FIG. 6 is a side view of the preferred embodiment of FIG. 1, further including a preferred canopy arrangement.

The reader must appreciate that there are many devices that are interchangeable with the above-described components of the preferred sun-tracking means 24. All of the components could be replaced with equivalent electronic parts that essentially accomplish the same function—detecting the sun's angular position with relation to the sun-tracking means 24, and outputting that information (in some form) for use in re-positioning a chair or chairs. The embodiment described in FIG. 6 is simply one easily-understood possibility. For the sake of brevity, and in order to focus on the true novelties of the present invention, Applicant has chosen not to describe all possible well-known device arrangements.

Figure 5:
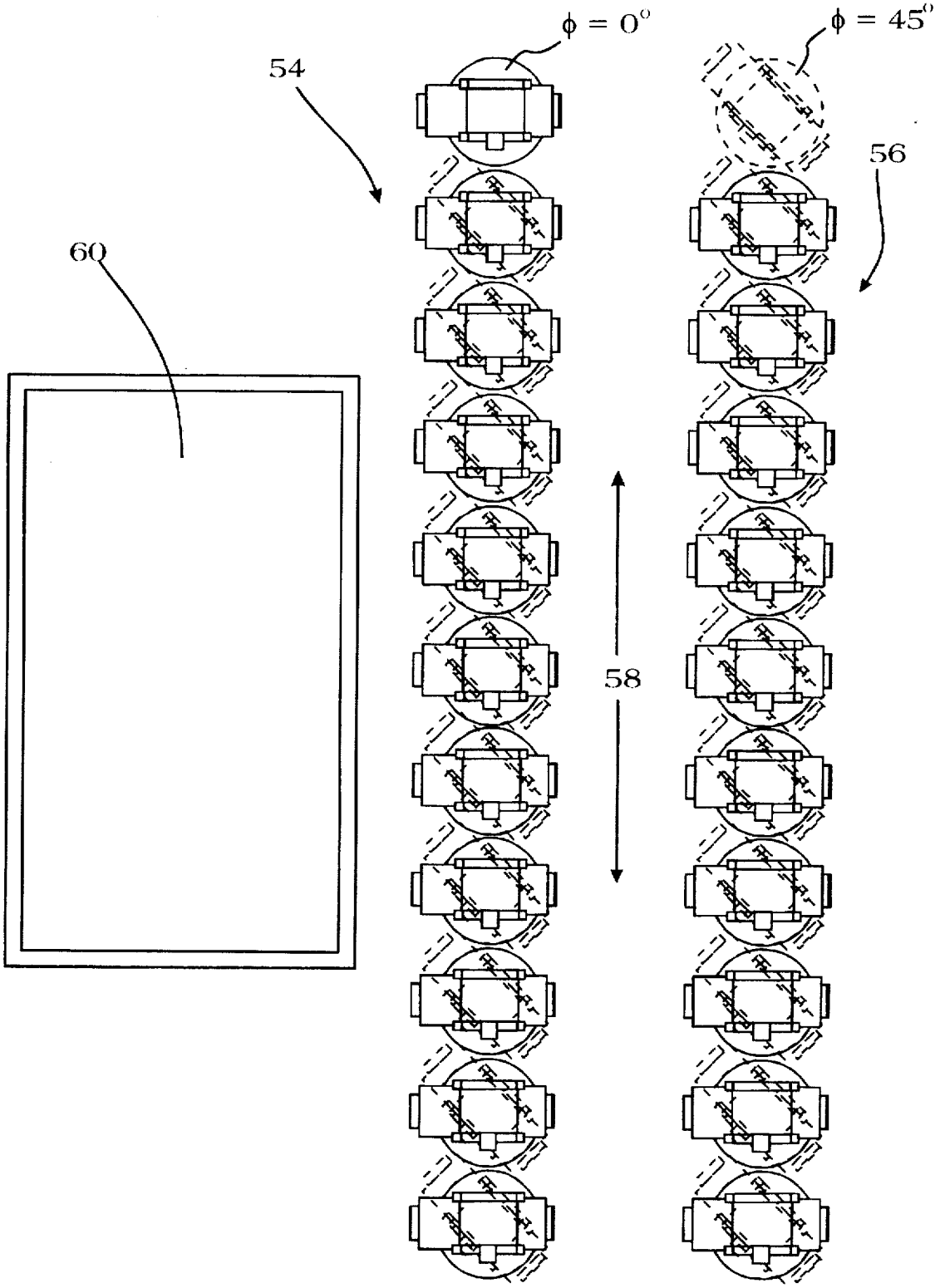
FIG. 5 is a top view of a preferred embodiment of the system of the present invention depicting the cooperation between adjacent chairs arranged in close proximity to each other.

Turning now to FIG. 5, we will examine another advancement of the present invention over the prior art. FIG. 5 is a top view of a preferred embodiment of the system of the present invention depicting the cooperation between adjacent chairs arranged in close proximity to each other. As can be seen, there are two rows of chairs 54 and 56, separated by a walkway 58. The rows 54 and 56 are very close to a swimming pool 60, which is often the case, particularly on cruise ships. As described above (see Background), chairs located this close together present a special problem with following the sun—they are close together to provide the most efficient use of suntanning areas, meaning their design goal is to be completely occupied with sunbathers, however, when they are fully occupied, the users find difficulty adjusting their chairs because they keep bumping into each other.

The present invention solves this problem by automatically adjusting the rotation angle $\phi$ of all chairs dependently and simultaneously, and between prescribed angular limits. The rows of chairs 54 and 56 show chairs with a rotation angle $\phi$ of 0° in solid lines (see first chair of row 54), and chairs with a rotation angle $\phi$ of 45° in hidden lines (see first chair of row 56) to demonstrate how the chairs can function together. The each chair in a row can either have its own sun-tracking means (see FIGS. 1,2 and 4), or a single, central, sun-tracking means can provide control data for all of the chairs, depending upon the particular situation.

It can be seen that the chairs have a full 90° range of rotation. It the sun's position has gone beyond where the chair can follow, the user simply needs wait until the sun has reached it relative apex, and then reverse his or her head and feet (as described above in connection with FIG. 1), in order to enable the chair to track the sun. This will provide 180° of tracking rotation in two 90° arcs. If full 360° tracking rotation is desired, the system can provide it, but the chairs will need to be spaced further apart, or even paired together (i.e. two chairs or more on a single rotating base).

FIG. 6 provides additional detail about the present invention. FIG. 6 is a side view of the preferred chair 10 of FIG. 1, further including a preferred canopy arrangement. In a preferred form the canopy arrangement will comprise a canopy layer 62 attached to the back rest 22, extending over and above the chair 10 and supported by a pair of struts 64 (only one shown). The struts 64 are preferably hinged to the chair and the canopy layer 62, so that as the back rest 22 adjusts to the sun's azimuth, the canopy will follow.

It should be noticed that the sun-tracking means 24, when attached to the back rest 22, is not obscured by the canopy layer 62 from the sun. Furthermore, the canopy arrangement is designed to permit the user to switch ends as described in FIG. 1, when desired, by simply (1) releasing the canopy layer 62 from the back rest 22 and folding the end over the top of itself, (2) attaching the canopy layer 66 to the leg rest 20 (now in a raised position), and (3) switching the strut from position 64 to position 68. In this form, the user will be protected from the sun, but will still be permitted to face the sun and/or rotate and adjust along with other chairs, such as in the configuration described above in connection with FIG. 5.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A sun-tracking chair system, comprising at least one chair, said chair comprising:

a base;

at least one support means extending upwardly from said base;

rotating means, attached to said support means, for rotating said chair on a substantially vertical axis;

a seating apparatus, comprising a backrest positioned at an incline angle to a center section, and said seating apparatus further defined by a spacial configuration said spacial configuration being defined as the rotational position of said seating apparatus around a substantially vertical axis, said seating apparatus attached to said support means;

configuration-adjusting means, attached to said seating apparatus, for adjusting said incline angle and said configuration responsive to the position of the sun; and sun-tracking means for detecting the position of the sun, said sun-tracking means in communication with said configuration-adjusting means and said rotating means.

2. The system of claim 1, wherein said configuration-adjusting means is responsive to the sun's azimuth.

3. The system of claim 2, wherein said rotating means is in communication with said sun-tracking means and said rotating is responsive to the angle of the sun in a horizontal plane.

4. The system of claim 3, wherein said seating apparatus further comprises:

a center section having a first edge opposing a second edge, and attached to said support means, said backrest extending from said first edge; and a leg rest extending from said second edge.

5. The system of claim 4, further comprising control means for controlling said configuration-adjusting means and said rotating means said control means attached to said seating apparatus to permit electrical, hydraulic or mechanical communication with said configuration-adjusting means and said rotating means, said control means configured to accept user input or input from said sun-tracking means.

6. The system of claim 5, further comprising a retractable canopy moveably attached to said seating apparatus, said canopy being moveable responsive to said incline angle and said rotating.

7. The system of claim 5, wherein said control means comprises a manual control circuit means for manually controlling said configuration-adjusting means and said rotating means, and an automatic control circuit means for automatically controlling said configuration-adjusting means and said rotating means responsively to the sun's position.

8. The system of claim 6, wherein said canopy includes canopy positioning means attached to said seating apparatus for positioning and retracting said canopy, said canopy being automatically retractable by said canopy positioning means responsive to said sun tracking means or in response to command from said control means.

9. The system of claim 1, comprising a plurality of said chairs, said rotating means of each said chair rotating synchronously in response to communication at least one said sun-tracking means, whereby one said sun-tracking means communicates with all said chairs in said plurality.

10. In an outdoor lounge chair, a sun-tracking device, comprising:

a seating apparatus, comprising a backrest positioned at an incline angle to a center section said center section forming a seating surface and said seating apparatus further defined by a configuration, said configuration being defined as the rotational position of said seating apparatus around a substantially vertical axis;

positioning means attached to said seating apparatus for positioning said incline angle and said configuration responsive to the azimuth and angle of the sun.

rotating means, attached to said seating apparatus, for rotating said chair on a substantially vertical axis;

sun-tracking means for tracking the azimuth and angle of the sun, said sun-tracking means in communication with said positioning means and said rotating means.

11. The device of claim 10, wherein said sun-tracking means comprises:

sun receiving means for accepting light rays incident thereon from the sun, said sun receiving means being an optical lens; and sun detecting means for detecting the azimuth and angle of the sun in relation to said sun receiving means, said detecting being solar cell means for the detection of incident light rays passing through said sun receiving means.

12. The device of claim 11, wherein said sun-tracking means further defines a sun's position, said sun's position being the azimuth and angle of the sun in relation to said sun receiving means, said positioning means is responsive to said sun's position.

13. An automated process for positioning a backrest and center section of at least one chair, said chair further defining an incline angle between said center section and said backrest, comprising the steps of:

detecting the location of the sun, said detecting being accomplished automatically by sun-tracking means; and automatically positioning said chair responsive to said location of the sun as communicated by said sun-tracking means, said positioning comprising rotating means rotating said center section and configuration-adjusting means adjusting said incline angle, said rotating means and configuration-adjusting means being responsive to said sun-tracking means.

14. The process of claim 13, wherein said detecting step comprises said sun-tracking means detecting the azimuth of the sun.

15. The process of claim 14, wherein said adjusting is responsive to said sun-tracking means detecting the azimuth of the sun.

16. The process of claim 15, wherein said detecting step further comprises said sun-tracking means detecting the angle of the sun in a horizontal plane.

17. The process of claim 16, wherein said rotating is responsive to said sun-tracking means detecting the angle of the sun in a horizontal plane.

* * * * *